US006140725A

United States Patent [19]

Jensen et al.

[11] Patent Number: 6,140,725

[45] Date of Patent: Oct. 31, 2000

[54] WET-RUNNING SUBMERSIBLE MOTOR FOR DRIVING A CENTRIFUGAL PUMP

[75] Inventors: Niels Due Jensen; Ole K. Sörensen, both of Bjerringbro, Germany

[73] Assignee: Grundfos A/S, Bjerringbro, Germany

[21] Appl. No.: 09/013,967

[22] Filed: Jan. 27, 1998

[30] Foreign Application Priority Data

Jan. 27, 1997 [DE] Germany ..... 197 02 723

[51] Int. Cl.[7] ..... H02K 5/132; F04D 13/08

[52] U.S. Cl. ..... 310/87; 310/67 R; 310/61; 417/357; 417/423.3

[58] Field of Search ..... 310/87, 90, 67 R, 310/58, 52, 61, 60 A; 417/357, 423.3, 423.11, 423.14

[56] References Cited

U.S. PATENT DOCUMENTS

| | | | |
|---|---|---|---|
| 3,135,211 | 6/1964 | Pezzillo | 310/87 |
| 3,264,653 | 8/1966 | Lebkuchner | 103/87 |

FOREIGN PATENT DOCUMENTS

| | | |
|---|---|---|
| 1454906 | 12/1966 | France . |
| 1098820 | 9/1959 | Germany . |
| 2160861 | 6/1972 | Germany . |
| 8029658 | 11/1980 | Germany . |
| 2941133 | 4/1981 | Germany . |
| 3828512 | 8/1988 | Germany . |
| 4217457 | 5/1992 | Germany . |
| 1925887 | 10/1995 | Germany . |
| 1237633 | 6/1971 | United Kingdom . |

*Primary Examiner*—Burton S. Mullins
*Attorney, Agent, or Firm*—Jacox, Meckstroth & Jenkins

[57] ABSTRACT

The wet-running submersible motor comprises a shaft and an electrical rotor arranged thereon, both being arranged in the rotor space of the motor. The shaft is formed hollow either on its longitudinal section on the pump side or over the whole length. On the pump side the shaft surrounds a sealing formation for sealing the rotor space of the motor with respect to the pump. Furthermore the hollow shaft is provided with radial flow passages in order to circulate fluid in the rotor space of the motor. Through the hollow shaft fluid is also led to the pump side, for which the shaft end on the pump side is provided with a fluid passable functional unit. The functional unit is formed so that it at least allows a fluid flow towards the pump side in order to bleed the rotor space and to reduce excess pressure in the rotor space which is subsequently filled with delivery fluid via the sealing formation, by way of fluid exit towards the pump side.

7 Claims, 6 Drawing Sheets

WET-RUNNING SUBMERSIBLE MOTOR FOR DRIVING A CENTRIFUGAL PUMP

BACKGROUND OF THE INVENTION

The invention relates to a wet-running submersible motor according to the preamble part of patent claim 1.

In DE-38 28 512 A1 there is shown a submersible pump unit with a wet-running motor, in which the motor, in a housing which is submersed into the fluid to be delivered, comprises a rotor which is surrounded by a split tube and is carried by a central shaft which is supported at both end regions of the motor in sliding bearings. To the pump side the shaft protruding out of the motor housing is surrounded by a sealing formation in order to seal the rotor space of the motor towards the pump side. Furthermore the shaft is formed hollow over its whole length and is connectable, at the end protruding out of the motor on the pump side, to a centrifugal pump. The shaft is at least partly filled with a fluid and at its end on the pump side is closed in a fluid tight manner with a closure stopper so that the fluid may not exit the shaft. Finally the space formed by the split tube, for the rotor of the motor is filled with fluid or the purpose of cooling. Via the intermediately connected cooling fluid in the hollow shaft, the motor heat is transmitted to the pump region or to the delivery fluid located here, in order to thus cool the motor.

During the transportation of the previously described wet-running motor or of the submersible motor pump unit, from the manufacturer to the location of application, where appropriate with intermediate storage of the motor or the unit until its point of time of application, considerable damage may occur on the wet-running motor due to fluid loss from the rotor space. As a result of this fluid loss, for example due to freezing temperatures during the transport and/or storage of the motor and the entailed destruction of the sealing formation, an insufficient cooling of the motor on later operation occurs, so that an overheating of the motor with again damage resulting therefrom is the result. The rotor space no longer contains adequate cooling fluid, since part of this has been previously lost. A further disadvantage lies in the fact that the packaging of the wet-running motor becomes damaged by the fluid running out of its rotor space and the demands made of it are no longer fulfilled. One has also therefore proceeded to deliver the wet-running motor with an unfilled rotor space or only partly filled with fluid. The motor must then however be completely filled with fluid before its installation or its starting up. This is time consuming and is not always carried out properly according to the instructions, this means that a complete filling of the rotor space is not ensured so that again an insufficient cooling of the motor is the result. Furthermore it must be ensured that the power data of the delivered motor are guaranteed at the customer. For this the wet-running motor before its delivery is checked with regard to this data with a filled rotor space at the manufacturer, is again subsequently emptied and then delivered in order to avoid the mentioned damage. In particular the emptying of the rotor space is time consuming and complicated, and with motors of a low power, for example up to about 4 kW, which may be manufactured relatively cheaply as a mass product, is a considerable cost factor.

BRIEF SUMMARY OF THE INVENTION

The object of the invention therefore lies in the improvement of a wet-running motor of the previously mentioned type to the extent such that its rotor space after starting up of the motor automatically bleeds and completely fills with fluid, wherein an exchange of fluid between the rotor space and the pump side of the motor during its starting up is largely avoided for preventing the disadvantages to the motor.

Proceeding from the wet-running submersible motor initially quoted, the solution of this object is specified in the characterizing part of claim 1.

A wet-running submersible motor designed according to the invention may be delivered after its manufacture with a part prefilling of its rotor space without serious considerations, since there is no longer any danger of leakage from the rotor space and it is ensured that the rotor space after the starting up of the motor automatically fills with part of the fluid to be delivered and at the same time simultaneously bleeds. It is no longer necessary that the motor is subsequently filled by assembly personnel at the location of the customers. After submersing the submersible motor which is not switched on, together with the submersible pump assembled on it into the fluid to be delivered, on account of the part prefilling an adequate minimum fluid quantity is present in the rotor space, which ensures a lubrication of the motor bearings and a sufficient cooling at the beginning of its operation. On the following switching on and switching off procedures of the motor or unit, via a sealing formation, part of the delivery fluid will penetrate into the rotor space and air will exit this space via the hollow shaft and its functional unit to the pump side, so that the rotor space is finally completely filled. On further operation of the motor, on account of the temperature increase of the motor, the fluid in the rotor space will expand. An excess pressure of the fluid which occurs with this in the rotor space is reduced in that the functional unit at the pump-side end of the hollow shaft of the motor opens and some fluid may escape via the shaft to the pump side. If after a corresponding cooling of the motor and thus also of the fluid in the rotor space an afterflow of fluid into the rotor space becomes necessary, then this afterflow to the rotor space is effected at least via the sealing formation. The sealing formation of the submersible motor is fundamentally formed with all embodiment forms such that a substantial fluid exchange between the rotor space and the pump side of the running motor no longer takes place when the rotor space is filled. The submersible motor formed according to the invention and its packaging further do not suffer damage during the transport and/or storage, since a leaking of fluid from the rotor space caused by freezing temperatures is avoided by the part prefilling of the rotor space.

The submersible motor is mainly applied for driving centrifugal pumps in wells, in particular deep wells, wherein with centrifugal pumps it is advantageously the case of multi-stage centrifugal pumps, with which the cold water is delivered upwards. The submersible motor may however also be used for operating centrifugal pumps in another relatively cold fluid. For this reason a constant exchange of fluid in the rotor space during motor operation is not required. In spite of this an adequate heat removal from the rotor space is ensured in comparison to an air filling of the rotor space.

One advantageous design of the functional unit in the shaft end region on the pump side protruding from the sealing formation lies in the fact that this unit is designed as a single acting valve passable in the direction of the pump, with a spring loaded valve body.

In order to simplify the penetration of delivery fluid into the rotor space of the motor, the mentioned functional unit, at the region of the hollow shaft of the motor on the pump side, may also be fluid passable in both axial directions of the shaft, i.e. by using a double valve. With such a design the wet-running motor or its rotor space may be delivered without fluid, e.g. with smaller constructional sizes. The double valve additionally lets fluid enter as well as letting air exit from the rotor space, so that this space fills with fluid more easily.

Further the submersible motor according to the invention with this design form may be tested on dry running, that is with an unfilled rotor space, if the customer does not wish to obtain a power data protocol for the wet-running submersible motor, should the manufacturer be able to guarantee that the power data of the submersible motor are ensured. By way of this the filling of the rotor space for the purpose of testing the submersible motor and the subsequent emptying of the rotor space may be done away with.

Further advantageous formations of the wet-running submersible motor according to the invention are indicated in further sub-claims.

BRIEF DESCRIPTION OF THE DRAWINGS

By way of example the invention is hereinafter described in more detail by way of the embodiments shown in the accompanying drawings. There is shown.

DETAILED DESCRIPTION OF THE INVENTION

Figure 1:
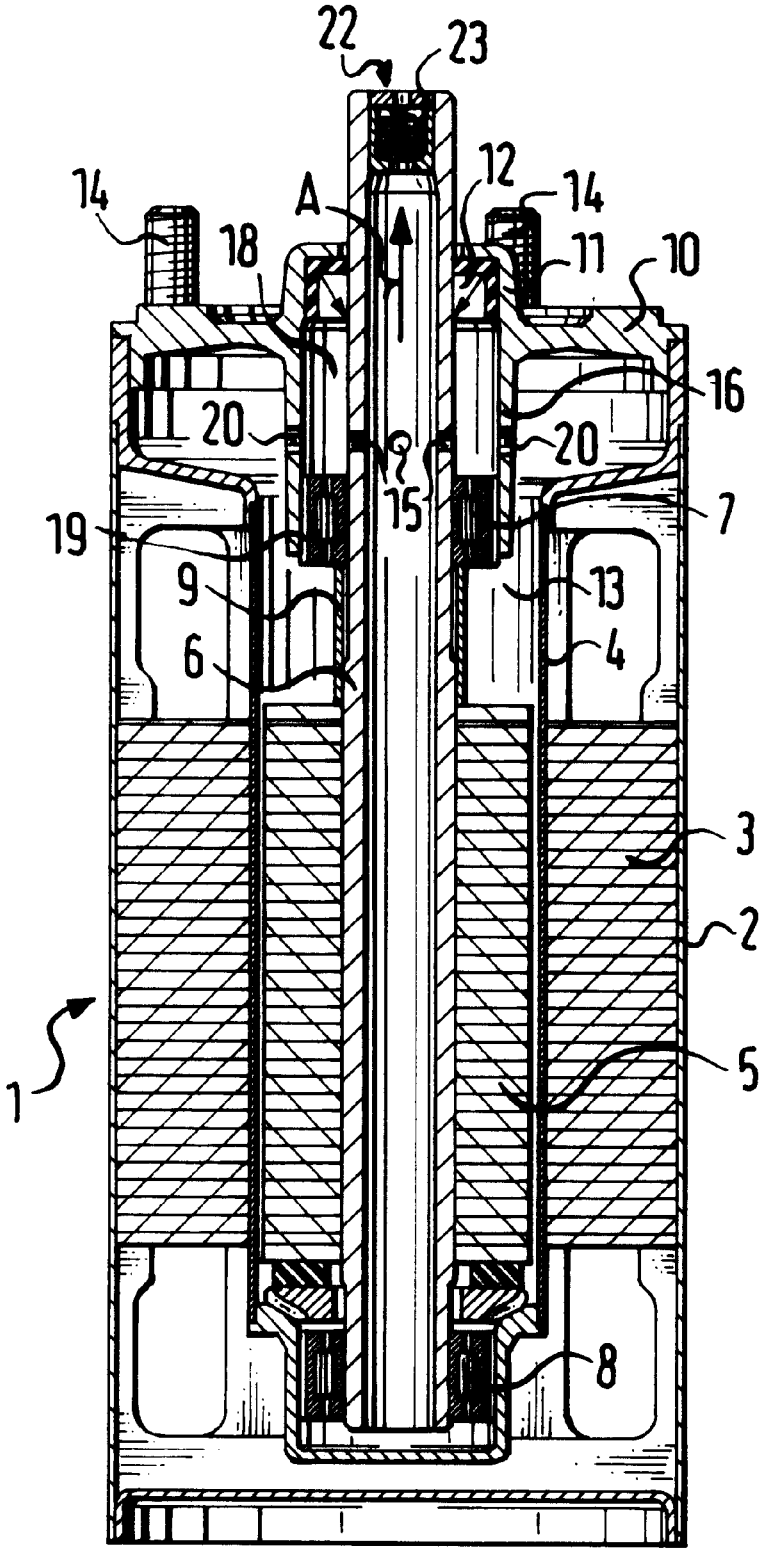
FIG. 1 an axial section through a wet-running submersible motor.

In FIG. 1 the wet-running submersible motor is shown completely. In an outer, tubular housing 2 there is located the usual electrical stator 3 which in its inner region is delimited by a split tube pot 4. At the end on the pump side the split tube pot 4 is connected fluid tightly to the housing 2 in the usual manner. In the inside of the split tube pot there is located the electrical rotor 5 which is fastened on a central motor shaft 6 which in the example shown is formed hollow over its whole length. The shaft 6 for its part is rotatably mounted in the usual manner in a front sliding bearing 7 and in a rear sliding bearing 8. Via a bearing sleeve 9 the rotor 5 on operation of the motor is supported axially on the front sliding bearing 7.

At its end on the pump side the motor 1 is provided with a terminal wall 10 which is rigidly connected to the housing 2 and is sealed with respect to this in the usual manner. The terminal wall 10 comprises in its central region a deepening 11 in which there is arranged a sealing formation 12. This formation 12 may be a lip seal, for example a radial packing ring. The usual sealing element, e.g. an annular lip, of the sealing formation bears sealingly on the hollow motor shaft 6 and thus seals the rotor space 13 of the motor 1 to the pump side, except for the usual leakage loss which is negligable. The sealing formation 12 is to be so arranged in the deepening 11 that the sealing effect of the sealing element of the sealing formation, on operation of the motor becomes larger the more the sealing element of the sealing formation 12 is impinged upon with fluid pressure from the inner side of the motor. This for example is symbolically indicated in the figures with the direction of the arrows 43 (FIGS. 2 and 3) drawn in the sealing formation 12. The sealing element is then pressed more strongly against the shaft 6.

At its pump side the terminal wall 10 is provided with several threaded pins 14 on which there is to be fastened the housing of the submersible pump of the centrifugal pump construction type, which is not shown, is as a rule multistage, and which is to be driven by the motor.

In front of the terminal wall 10 the hollow shaft 6 is provided with inner radial flow passages 15 so that when the rotor space 13 is filled with fluid, a fluid circulation within the rotor space may take place in the usual manner. The hollow shaft also exerts a pump effect on operation of the motor 1 when the rotor space 13 is only partly prefilled with fluid. It is thus ensured that the lower sliding bearing 8 as well as the upper radial sliding bearing 7 are sufficiently lubricated at the beginning of operation of the motor.

The hollow shaft 6 is surrounded by a sleeve 16 at a radial distance, the sleeve extending toward the inside from the terminal wall 10. The sleeve 16 at its end on the motor side serves as a carrying body for the front sliding bearing 7. In this manner there is formed a chamber 18 which extends from the sealing formation 12 as an annular space up to the front shaft gliding bearing 7. This chamber ensures that the fluid which reaches into this chamber via the flow passages 15 of the shaft 6 is forcably led by the shortest route to the sliding bearing 7 in order to securely lubricate this. Furthermore the bearing 7 at its outer circumference may be provided with several flow paths 19 in order to lead fluid into the rotor space 13. Additionally or alternatively holes 20 may also be provided in the sleeve 16 in order to lead fluid into the front part of the rotor space 13.

In the end region of the hollow motor shaft 6 which protrudes centrally towards the outside from the terminal wall, there is located the functional unit 22. According to FIG. 1 this functional unit is formed such that fluid, under certain conditions may escape from the rotor space 13 towards the pump side via the shaft 6. Firstly this will essentially be air in order to bleed the rotor space which is partly prefilled on manufacture. The simultaneous penetration of fluid from the pump side is effected via the sealing formation 12 since this, as is indicated by the arrow 43 directed towards the inside, is so formed and assembled that the penetration of delivery fluid from the pump into the rotor space 13 for the purpose of its complete filling is ensured without the required sealing effect of the seal 12 being significanly weakened. With this the penetrating through of the delivery fluid between the shaft 6 and the seal 12 may already be sufficiently effected when the unit consisting of the motor 1 and pump (not shown) is for example submersed one meter deep into the delivery fluid. Already then a certain subsequent filling quantity of delivery fluid may penetrate into the rotor space 13. The complete filling of the rotor space 13 with fluid and the simultaneous bleeding via the functional unit 22 towards the pump side is then effected by the repeated switching on and off procedures of the motor, so that it is ensured that after a relatively short operating time the rotor 13 is completely filled with fluid.

In order to make easier the penetration of delivery fluid into the rotor space 13, the functional unit 22 may also be formed so that additionally to the path via the sealing formation 12, via this unit 22 too delivery fluid may penetrate in order to fill the delivery space 13 via the flow passages 15. Simultaneously with this however also a bleeding of the rotor space, that is a removal of air from this space, may be effected via the functional unit 22 according to the arrow A. When the rotor space 13 is completely filled with delivery fluid and this fluid heated due to heat production in the rotor 5 during the course of operation of the motor 1, then there arises an excess pressure in the rotor space. This excess pressure is likewise immediately reduced via the functional unit 22 because then via this unit a certain small part of fluid may escape to the pump.

The functional unit 22 may therefore be provided in various embodiments. Whilst in FIGS. 1 and 2 such a unit is shown which permits a fluid passage in one direction, that is only towards the pump side, in FIGS. 3 and 4 such a unit is shown which permits a fluid flow towards the pump side as well as simultaneously from the pump side to the rotor space. With the embodiment form according to FIGS. 1 and 2 it is the case of a single acting valve 23, whilst in FIGS. 3 and 4 it is the case of a double valve 24.

Figure 2:
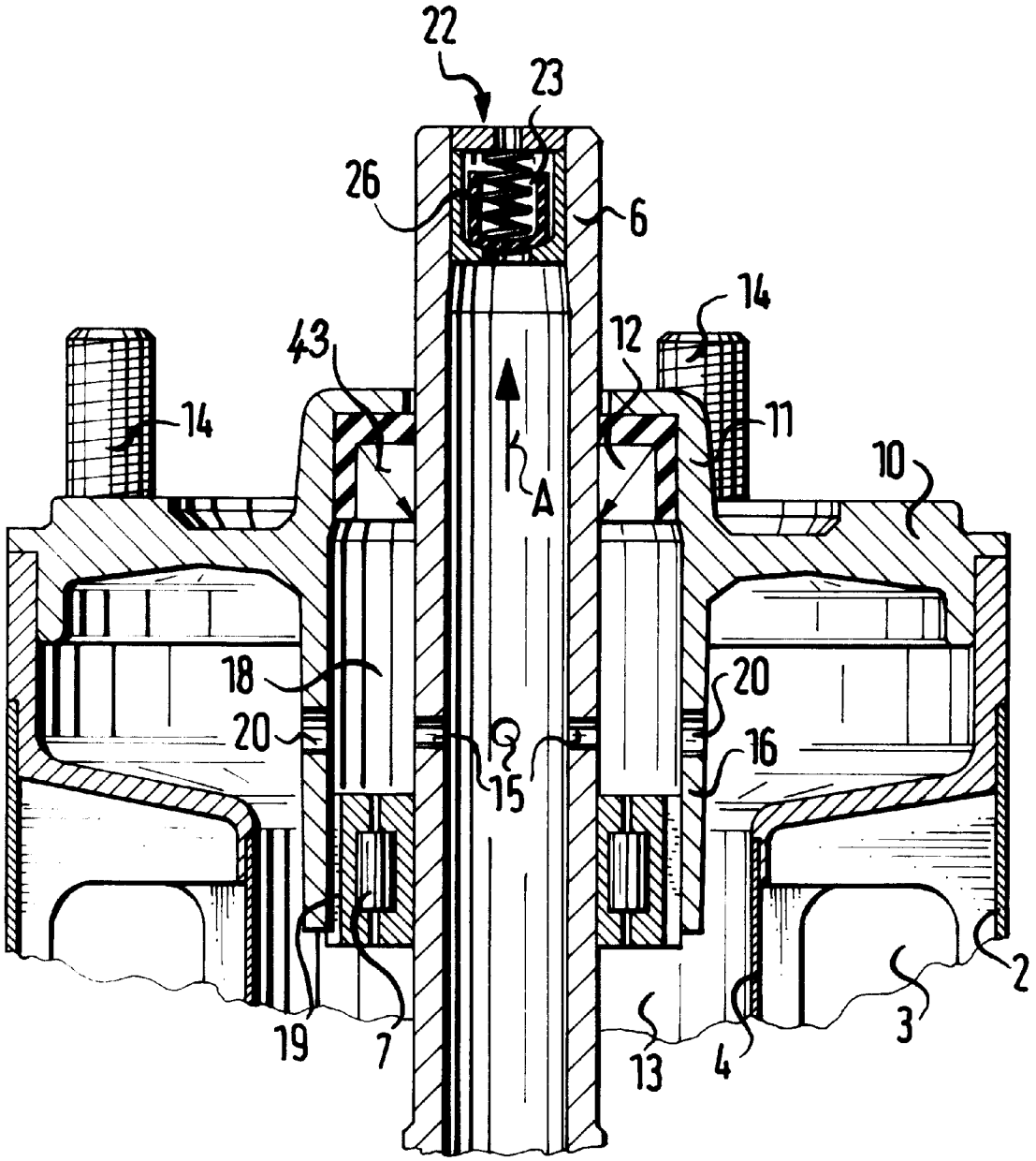
FIG. 2 a part representation of the embodiment form according to FIG. 1, in an enlarged scale with a first functional unit, FIG. 3 a substantially equal representation to FIG. 2 with a second functional unit, FIG. 4 the second functional unit alone, in an enlarged scale and in axial section, FIG. 5 an axial section through a further embodiment form of the wet-running submersible motor, FIG. 6 a further embodiment form altered with respect to the embodiment form according to FIG. 5, wherein only its region on the pump side is shown in simplified representation and in axial section, FIG. 7 a representation, similar to FIG. 2, of yet another embodiment form of the submersible motor.

In FIG. 2 the functional unit 22 in the form of a single acting valve 23 can be recognised more clearly. One can see that it is the case here of a valve with a spring loaded valve body 26. According to arrow A the valve body 26 is lifted from its seat when on operation of the motor there is formed an excess pressure in the rotor space 13 and in the chamber 18. This excess pressure is firstly exerted by the air in the rotor space, which at the same time continually escapes via the valve 23, this being on account of the delivery fluid penetrating more and more into the rotor space. Afterwards with a filled rotor space, the fluid warmed by the running motor in this space likewise exerts a pressure on the valve in order to reduce the fluid excess pressure.

Figure 3:
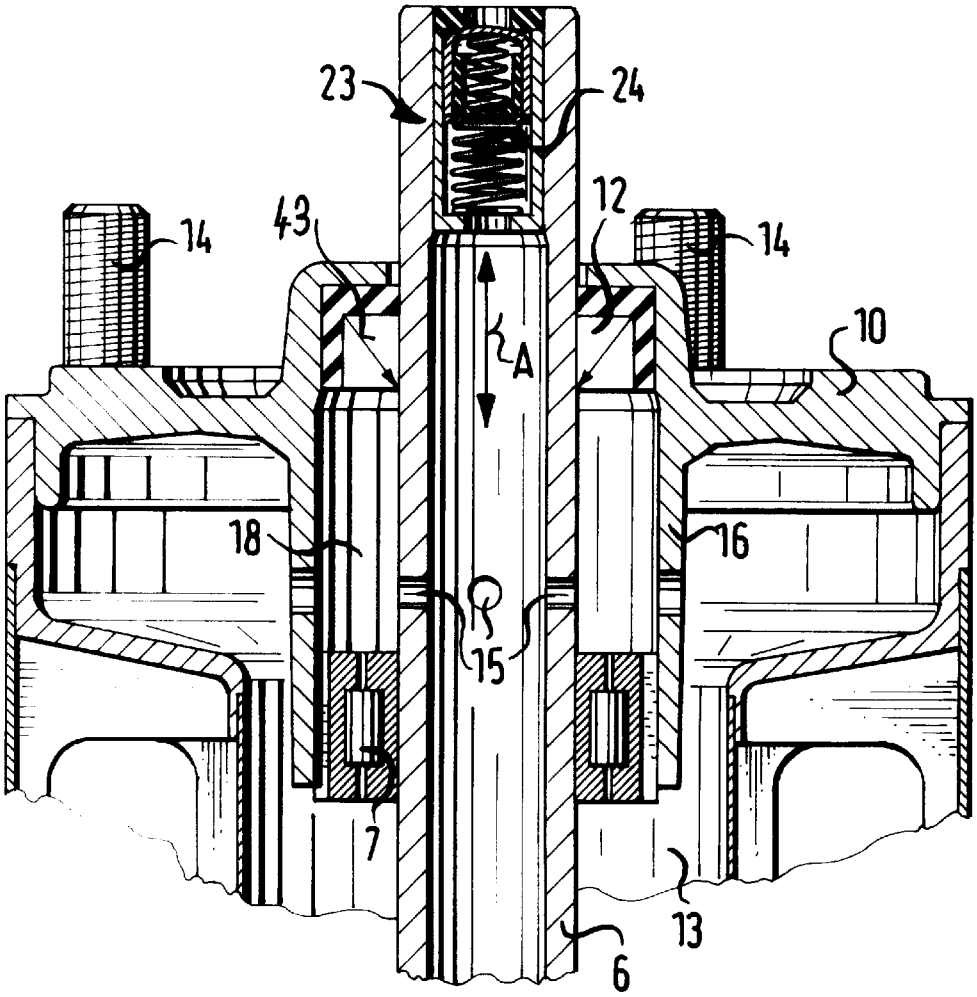
Figure 4:
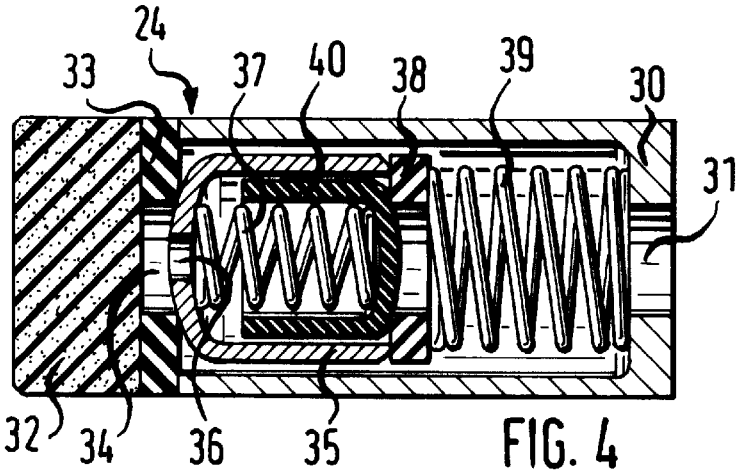

In FIGS. 3 and 4 the double valve 24 designed as a two directional valve can be clearly recognised in its construction. It comprises a common cylindrical housing 30 with a rear passage opening 31 and a filter insert 32 on the pump side. A corresponding filter insert may also be provided in front of the single acting valve 23 according to the FIGS. 1, 2, 3, 5, 6 and 7. Within the housing 30 on the pump side there is provided a first valve seat ring 33 with a front passage opening 34, wherein on the rotor space side a first tubular valve body 35 bears on the valve seat ring 33. On the pump side this valve body 35 has a central passage 36 which communicates with the opening 34. A first weighting spring 37, for example a helical spring, presses the valve body 35 against the valve seat ring 33. At the open end of the first valve body 35 on the rotor space side there bears a second valve seat ring 38, this being with the help of the pressure of a second weighting spring 39, which on the other side bears on the housing 30 and may likewise be a helical spring. Within the first valve body 35 there is located an axially displaceably held second tubular valve body 40, this being with circumferential play. By way of such a formed annular gap between the valve bodies fluid may flow out of the rotor space. The second valve body 40 is closed on the motor side and is pressed by the first weighting spring 37 against the second valve seat ring 38. Both weighting springs 37 and 39 are advantageously so calculated that the outflow of the fluid from the rotor space 13 towards the pump side is more easily possible than the penetration of delivery fluid from the pump side towards the rotor space.

Figure 5:
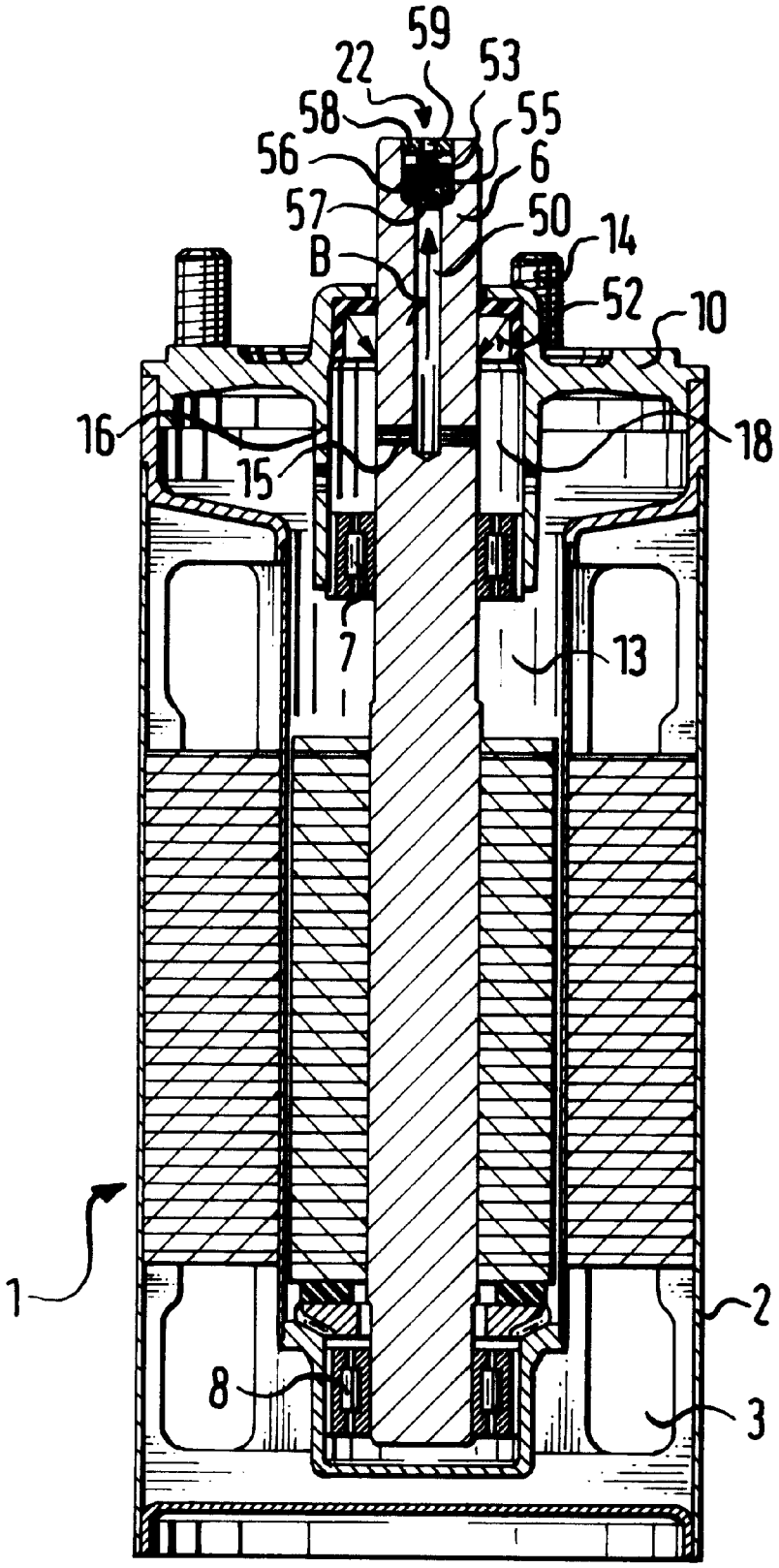

In FIG. 5 a further modified embodiment form of the invention is represented. The most essential modification with this embodiment example with respect to the previously described embodiment forms lies in the fact that the motor shaft 6 is formed hollow only in part of its length. The shaft is formed hollow only from the pump side, thus has a central channel 50 which extends up to the region at the beginning of the rotor space 13 of the motor. From the inner end of the channel 50 in turn flow passages 15 open to the rotor space 13. With this example a chamber 18 may likewise be formed by the sleeve 16. Also with this embodiment example it is the case that the sealing formation 12 is so formed and assembled that fluid can only get from the pump side through the seal 12 towards the rotor space 13, thus a backflow in the opposite direction is not possible so that then according to arrows 52 with an inner pressure on the seal, its sealing effect is strengthened. In the case represented, the functional unit 22 consists of a single acting valve 53 with a spring loaded valve body, wherein this valve only allows a fluid flow according to the arrow B from the rotor space to the pump side. The valve 53 is layed into a recess 55 at the shaft end on the pump side and comprises a valve body 56 which on the one side is supported on the shaft 6 and on the other side is kept in the closing position by way of a compression spring 57. On the one side the compression spring supports itself on a holding element 58 with a central passage 59. In place of the valve 53 with a passage direction only to the pump side, also with this example a functional unit with two opposing passage directions may be employed, for example the double valve 24.

Figure 6:
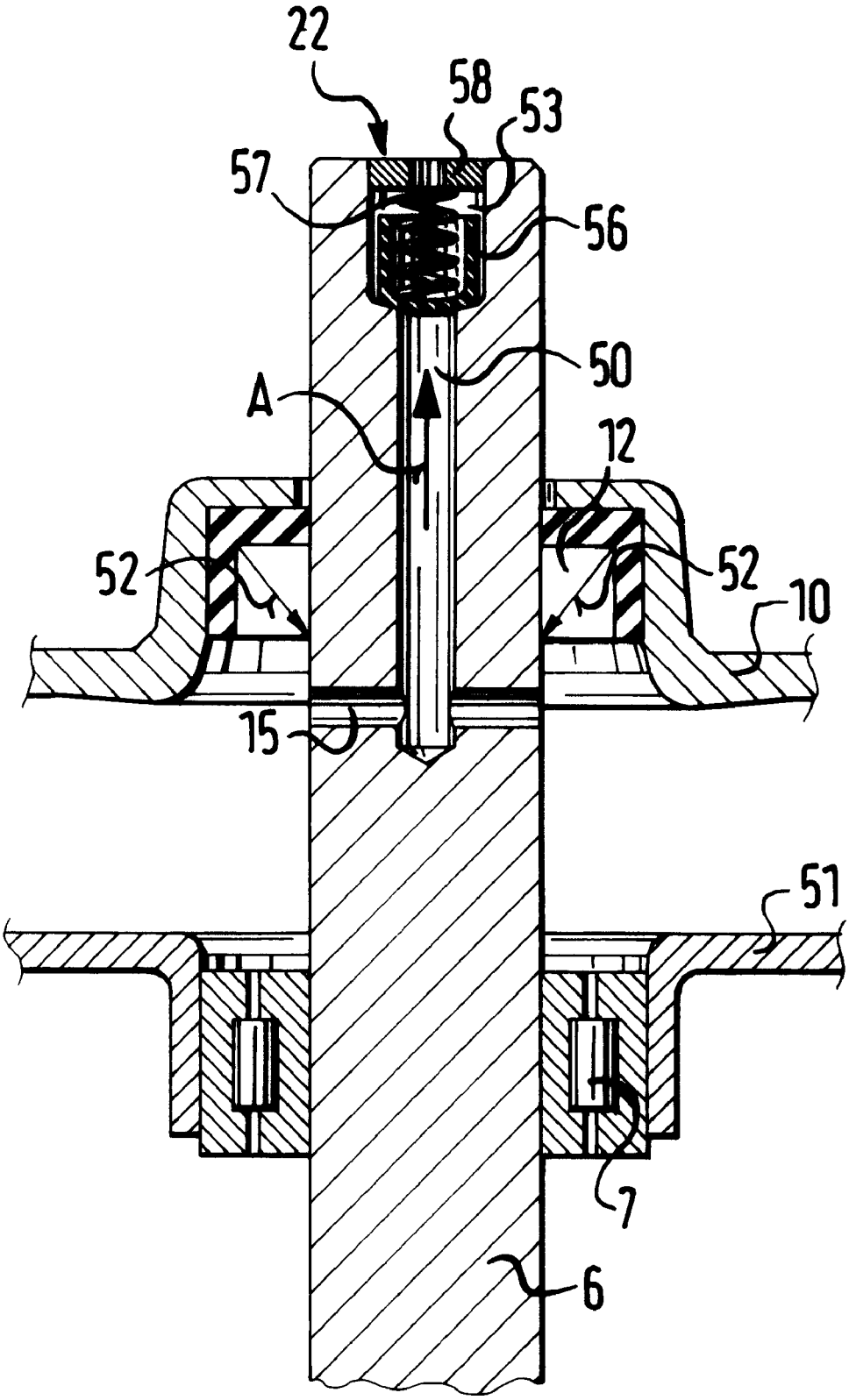

The embodiment form according to FIG. 6 is modified with respect to that according to FIG. 5 in as much as there is no chamber 18 provided. The front sliding bearing 7, where appropriate with its axial passages 19, is therefore held in its own end plate 51 in order to support the shaft at the front. Otherwise there is no difference to the embodiment form according to FIG. 5.

The embodiment forms according to FIGS. 5 and 6 would be selected when the wet-running submersible motor 1 is operated at relatively low rotational speeds. The embodiment examples described much earlier are suitable in particular for very high rotational speeds of wet-running submersible motors.

Figure 7:
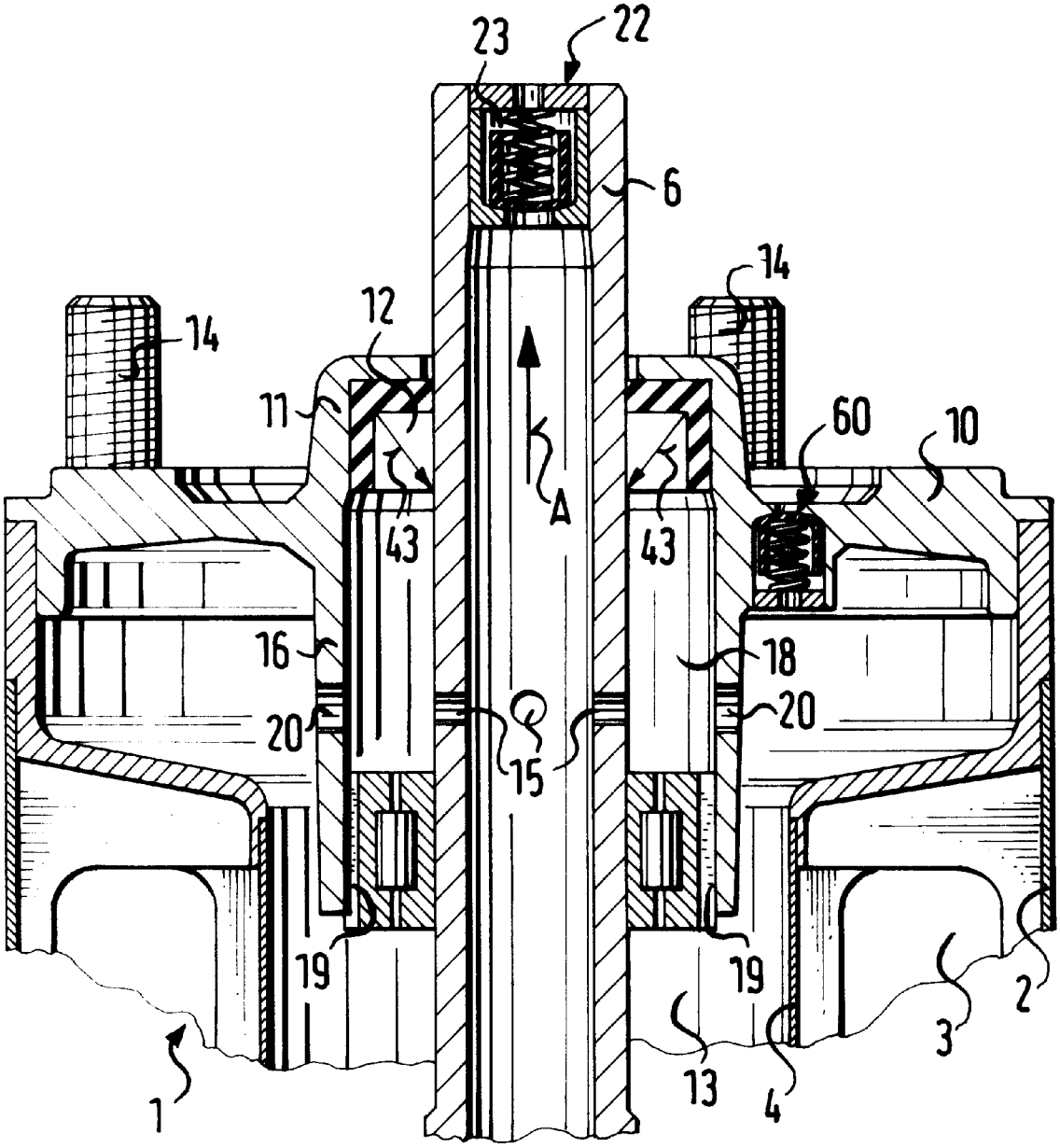

FIG. 7 shows yet a further embodiment example. This embodiment example has one differentiating feature with respect to the previously described embodiment examples, to which it otherwise corresponds, in that in the front terminal wall 10 of the motor 1 there is provided an inlet valve 60. This valve is so constructed and so assembled in the wall 10 that it only admits delivery fluid into the rotor space 13 of the motor from the pump side, thus blocks in the reverse direction, and is only applied under certain delivery conditions. There may be application cases, for example when the delivery fluid is relatively tough, thus having a relatively low viscosity, in which the additional presence of an inlet valve in the region of the front terminal wall 10 is useful in combination with the explained sealing formation 12, in order to securely supplementarily fill the rotor space of the submersible motor with delivery fluid. The construction of the one directional valve 60 itself may be formed as is described in connection with the single acting valve 23.

What is claimed is:

1. A wet-running submersible motor for driving a centrifugal pump, with a shaft in the rotor space, fillable with fluid, of the motor and carrying an electrical rotor, the shaft being formed hollow at least on its longitudinal section on the pump side, and with a sealing formation provided in a terminal wall on the pump side of the motor and surrounding the shaft for sealing the rotor space with respect to the pump, said shaft is mounted in sliding bearings arranged in front of and behind the rotor and is provided with radial flow passages within the motor, wherein the hollow shaft end on the pump side comprises a valve passable in the direction to the pump, with a spring loaded valve body in order, on operation of the motor, to let through fluid out of the rotor space to the pump for the purpose of bleeding said rotor space which can be filled automatically with a delivery fluid from the pump at least via said sealing formation in said terminal wall and to reduce excess pressure in said rotor space with respect to a fluid pressure in the pump acting on said motor.

2. A wet-running submersible motor according to claim 1, wherein a filter is situated in front of said double valve.

3. A wet-running submersible motor for driving a centrifugal pump, with a shaft in the rotor space, fillable with fluid, of the motor and carrying an electrical rotor, the shaft being formed hollow at least on its longitudinal section on the pump side, and with a sealing formation provided in a terminal wall on the pump side of the motor and surrounding the shaft for sealing the rotor space with respect to the pump, said shaft is mounted in sliding bearings arranged in front of and behind the rotor and is provided with radial flow passages within the motor, wherein the hollow shaft end on the pump side comprises a valve passable in the direction to the pump, with a spring loaded valve body in order, on operation of the motor, to let through fluid out of the rotor space to the pump for the purpose of bleeding said rotor space which can be filled automatically with a delivery fluid from the pump at least via said sealing formation in said terminal wall and to reduce excess pressure in said rotor space with respect to a fluid pressure in the pump acting on said motor;

wherein a filter is situated in front of said valve.

4. A wet-running submersible motor for driving a centrifugal pump, with a shaft in the rotor space, fillable with fluid, of the motor and carrying an electrical rotor, the shaft being formed hollow at least on its longitudinal section on the pump side, and with a sealing formation provided in a terminal wall on the pump side of the motor and surrounding the shaft for sealing the rotor space with respect to the pump, said shaft is mounted in sliding bearings arranged in front of and behind the rotor and is provided with radial flow passages within the motor, wherein the hollow shaft end on the pump side comprises a valve passable in the direction to the pump, with a spring loaded valve body in order, on operation of the motor, to let through fluid out of the rotor space to the pump for the purpose of bleeding said rotor space which can be filled automatically with a delivery fluid from the pump at least via said sealing formation in said terminal wall and to reduce excess pressure in said rotor space with respect to a fluid pressure in the pump acting on said motor;

wherein the sealing formation is formed in such a manner that, with an excess fluid pressure in the rotor space, the exit of fluid from the rotor space is prevented.

5. A wet-running submersible motor for driving a centrifugal pump, with a shaft in the rotor space, fillable with fluid, of the motor and carrying an electrical rotor, the shaft being formed hollow at least on its longitudinal section on the pump side, and with a sealing formation provided in a terminal wall on the pump side of the motor and surrounding the shaft for sealing the rotor space with respect to the pump, said shaft is mounted in sliding bearings arranged in front of and behind the rotor and is provided with radial flow passages within the motor, wherein the hollow shaft end on the pump side comprises a double valve which in both axial directions of the shaft opens as well as closes in order to permit fluid to flow out of the rotor space to the pump for the purpose of bleeding said rotor space;

said rotor space being fillable automatically with a delivery fluid from the pump at least via the sealing formation in said terminal wall to reduce excess pressure in said rotor space with respect to a fluid pressure in the pump acting on said motor.

6. A wet-running submersible motor according to claim 5, wherein the double valve comprises a common housing with a front and rear passage opening, in the housing there being provided a first valve seat ring on the pump side, a first tubular valve body on the rotor space side with a central passage on the pump side, a first weighting compression spring, a second tubular valve body axially displaceably held with circumferential play within the first tubular valve body, a second valve seat ring provided at the open end on the rotor space side of the first valve body, and a second weighting compression spring supported on the second valve seat ring and the common housing, wherein the first weighing compression spring is supported on the first and second valve body.

7. A wet-running submersible motor according to claim 5, wherein the sealing formation for the shaft is formed in such a manner that with an excess fluid pressure in the rotor space the exit of fluid from the rotor space is prevented.

* * * * *